US005591048A

United States Patent [19]

Hahn

[11] Patent Number: 5,591,048

[45] Date of Patent: Jan. 7, 1997

[54] MULTIPLE FISH HOOK HOLD-DOWNS

[75] Inventor: Marlyn E. Hahn, York, Pa.

[73] Assignee: Berg Technology, Inc., Reno, Nev.

[21] Appl. No.: 570,362

[22] Filed: Dec. 11, 1995

Related U.S. Application Data

[63] Continuation of Ser. No. 240,917, May 10, 1994, abandoned.

[51] Int. Cl.[6] ..... H01R 13/73

[52] U.S. Cl. ..... 439/567

[58] Field of Search ..... 439/567, 571, 439/572; 411/508–510, 913, 456

[56] References Cited

U.S. PATENT DOCUMENTS

| | | | |
|---|---|---|---|
| 4,495,380 | 1/1985 | Ryan et al. | 411/508 |
| 5,083,942 | 1/1992 | Hahn | 439/571 |
| 5,135,412 | 8/1992 | Sitzler | 439/567 |
| 5,171,165 | 12/1992 | Hwang | 439/567 |
| 5,228,870 | 7/1993 | Gorenc et al. | 439/567 |

FOREIGN PATENT DOCUMENTS

| | | | |
|---|---|---|---|
| 480240 | 2/1938 | United Kingdom | 411/508 |

*Primary Examiner*—Gary F. Paumen

*Attorney, Agent, or Firm*—Woodcock Washburn Kurtz Mackiewicz & Norris

[57] ABSTRACT

The current invention is directed to multiple fish hook hold-downs to secure a connector housing to a circuit assembly at least prior to or during soldering of electrical terminals mounted in the connector to the circuit board. The multiple fish hook hold-down comprises contact portions whose one ends are joined together to form a common adjoining portion, intermediate portions whose proximal ends are integral with the other ends of the contact portions, and fish hook portions integral with distal ends of the intermediate portions. The multiple fish hook hold-downs are initially placed in the connector housing at the contact portion of the hold-down. Prior to assembly, the circuit assembly and the connector housing with the hold down in place may be separately transported. When assembling, fish hook portions of the hold-down are placed in a hold-down engagement hole, and the fish hook portions anchor themselves on an inside surface of the hole so as to secure the connector housing onto the circuit assembly. The anchored fish hook portions are further spread against the inside wall to dig into the inside wall for a stronger retention force between the connector housing and the circuit assembly.

17 Claims, 8 Drawing Sheets

MULTIPLE FISH HOOK HOLD-DOWNS

This is a continuation of application Ser. No. 08/240,917, filed May 10, 1994, now abandoned.

BACKGROUND OF THE INVENTION

1. Field of the Invention

The current invention relates to a hold-down for securing a component to a circuit assembly and more particularly to a multiple fish hook hold-down for securing a connector housing to a printed circuit board.

2. Description of the Related Art

An apparatus to secure a connector to a printed circuit board is generally known as a hold-down. Prior art hold-downs at least temporarily secure a connector housing onto a printed circuit board, prior to or during soldering of electrical terminals mounted in the connector, by providing an interference fit. Usually, such an interference fit is caused by contact between a press-fit section of the connector housing and an inside wall of the fitting hole on the circuit board. These interference-fit hold downs, however, lack a sufficient amount of retention force, and consequently, they require a special seating tool to increase the retention force.

To improve on the retention force, U.S. Pat. No. 5,083,942 discloses a single fish hook hold-down for securing a connector housing to a circuit assembly. According to the '942 patent, a fish hook hold-down comprises an anchoring portion at one end, an attaching portion at the other end and an elongated portion between the two ends. The fish hook hold-down is firmly fixed to the connector housing by the attaching portion. In order to at least temporarily stabilize the connector housing on the circuit assembly, the fish-hook-like anchoring portion of the hold-down is inserted into a through hole on the circuit assembly. As the insertion takes place, the tip of the anchoring structure is urged against an inside wall of the through hole and anchors the hold-down to the circuit assembly. As a result, the single fish hook hold-down more securely holds the connector housing to the circuit assembly than the prior art interference fit hold-downs.

Despite the above desirable features, the hold-down disclosed by the '942 patent has at least three major areas for improvement. First, since the anchoring portion of the hold-down is at the opposite end of the elongated portion from the attaching portion and the anchoring portion must be firmly urged against the inner wall of the through hole on the circuit assembly, the attaching portion needs to be firmly and precisely positioned in the connector housing. Thus, the connector housing requires a particular chamber for accepting the attaching portion. Secondly, even though the hold-down is firmly held in the connector housing, the anchoring portion must be precisely aligned with the through hole in the circuit assembly. Any slight misalignment can prevent the anchoring portion from firmly engaging the inside wall of the through hole, and the connector housing is not secured to the circuit assembly. Lastly, even when the connector housing with the hold-down is precisely aligned and inserted with respect to the through hole on the circuit assembly, a single anchoring point per hold-down does not always yield a desirable amount of retention force for the circuit assembly. The current invention is directed to these and other imperfections and substantially improving over the above-discussed prior art. Thus, the objects of the current invention include at least the following.

It is an object of the current invention to provide a fish hook hold-down that has a higher tolerance for misalignment during insertion into a retaining through hole.

It is another object of the current invention to provide a fish hook hold-down that accommodates a simplified connector housing for retaining the hold-down.

It is yet another object of the current invention to provide a fish hook hold-down that yields a higher retention force.

SUMMARY OF THE INVENTION

According to the current invention, a hold-down holds a connector housing to a circuit assembly which has a hold-down engagement hole. The hold-down comprises a plurality of connector housing contact portions for securing the hold-down to the connector housing, a plurality of intermediate portions each having a first end and a second end; the first end of each of the intermediate portions being integral with one end of the connector housing contact portion; an adjoining portion located at the other end of the connector housing contact portion for adjoining the plurality of the connector housing contact portions; and a plurality of fish hooks each integral with the second end of the intermediate portion, each of the fish hooks having a proximal end adjacent to the second end of the intermediate portion and a distal end opposite the proximal end, a portion near the distal end being angled with respect to an axis along a portion near the proximal end and the intermediate portion and defining an angled tip, the angled tip resiliently engaging an inner wall of the hold-down engagement hole of the circuit assembly.

According to the second aspect of the current invention, a fish-hook hold-down which holds a connector housing to a circuit assembly with a hold-down engagement hole, comprises: a plurality of connector housing contact portions for securing the fish-hook hold-down to the connector housing; a plurality of intermediate portions each having a first end and a second end, the first end of each of the intermediate portions being integral with one end of the connector housing contact portion; a plurality of fish hooks each integral with the second end of the intermediate portion, each of the fish hooks having a proximal end adjacent to the second end of the intermediate portion and a distal end opposite the proximal end, a portion near the distal end being angled with respect to an axis along a portion near the proximal end and the intermediate portion and defining an angled tip, the angled tip resiliently engaging an inner wall of the hold-down engagement hole of the circuit assembly, a portion between the proximal end and the distal end defining a curved portion, the curved portion serving as a spring to urge the angled tip against the inner wall of the hold-down engagement hole of the circuit assembly so as to increase a retention force of the hold-down for retaining the circuit assembly; and an adjoining portion located at the other end of the connector housing contact portions for adjoining the plurality of the contact portions, the adjoining portion serving as a spring to urge the connector housing contact portions against the connector housing to increase a retention force of the hold-down for retaining the connector housing.

According to the third aspect of the current invention, a method of placing a fish-hook hold-down secures a connector housing to a circuit assembly which has a first side and a second side. A hold-down engagement hole connects the first side and the second side. The fish-hook hold-down comprises a connector housing contact portion, intermediate portions, and fish-hook portions. Each of the fish-hook portions has an angled tip. The method comprises the steps of: securing the hold-down to the connector housing; inserting the fish-hook portion into the hold-down engagement hole from the first side towards the second side of the circuit assembly so that the fish-hook portions engage an inner wall of the hold-down engagement hole; and spreading the angled tip of each of the fish-hook portions towards the second side until the angled tip further urges against the inner wall.

According to the fourth aspect of the current invention, a system for placing a fish-hook hold-down so as to secure a connector housing to a circuit assembly which has a first side, a second side, and a hold-down engagement hole connecting the first side and the second side, comprises: the hold-down which includes a plurality of connector housing contact portions for securing the hold-down to the connector housing; a plurality of intermediate portions each having a first end and a second end, the first end of each of the intermediate portions being integral with one end of the connector housing contact portion; an adjoining portion located at the other end of the connector housing contact portion for adjoining the plurality of the contact portions; and a plurality of fish hooks each integral with the second end of the intermediate portion, each of the fish hooks having a proximal end adjacent to the second end of the intermediate portion and a distal end opposite the proximal end, a portion near the distal end being angled with respect to an axis along a portion near the proximal end and the intermediate portion and defining an angled tip; a first applicator detachably placed on the adjoining portion for inserting the fish hooks into the hold-down engagement hole towards the second side of the circuit assembly, the angled tip resiliently engaging an inner wall of the hold-down engagement hole of the circuit assembly; and a second applicator detachably placed on the angled tips for spreading the angled tips of the fish hooks towards the second side until the angled tip further urges against the inner wall.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

BRIEF DESCRIPTION OF THE INVENTION

DETAILED DESCRIPTION OF THE PREFERRED EMBODIMENT(S)

Figure 1A:
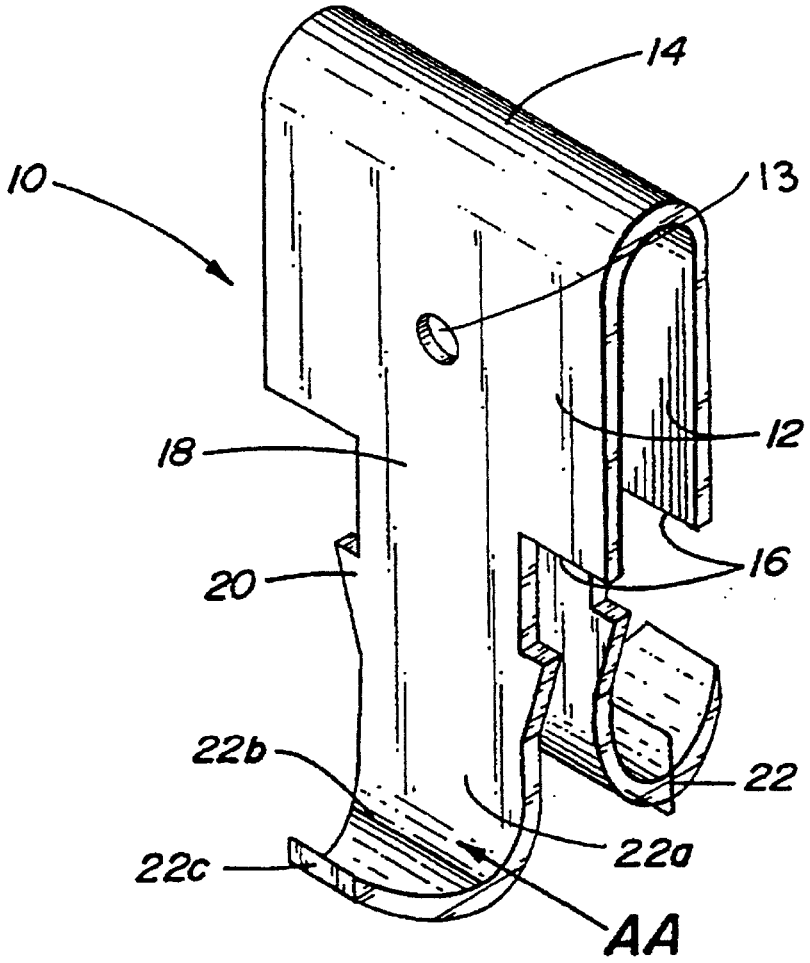
FIG. 1A is a perspective view of one embodiment of a fish hook hold-down according to the current invention.

Referring now to the drawings, wherein like reference numerals designate corresponding structure throughout the views, and referring in particular to FIG. 1A, one preferred embodiment of a fish hook hold-down 10 according to the current invention is illustrated in a perspective view. The fish hook hold-down 10 comprises a pair of connector housing contact portions 12. At one end of the connector housing contact portions 12, an adjoining portion 14 joins the pair of the connector housing contact portions 12. The other ends of the connector housing contact portions 12 for downwardly facing shoulders (end surfaces) which project in a horizontal direction parallel to a top surface of the connector housing when placed in the connector housing. The connector housing contact portions 12 further comprise a grip area 13 for providing a grip to hold the fish hook hold-down Although a disclosed embodiment in FIG. 1A shows a bore as a grip area, the grip area can be a detent or a protrusion.

Still referring to FIG. 1A, each of the connector housing contact portions 12 is integral with a proximal part of an intermediate portion 18. A pair of barbs 20 protrudes from the side of the intermediate portion 18, when the hold-down 10 is placed in the connector housing, these barbs 20 have an interference fit to temporarily secure the hold-down 10 to the connector housing. A distal part of the intermediate portion 18 is integral with a fish hook portion 22.

Figure 1B:
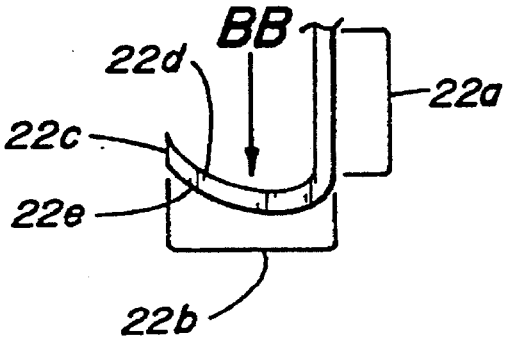
FIG. 1B is a side view of a fish hook portion of the hold-down as viewed from AA in FIG. 1A.
Figure 1C:
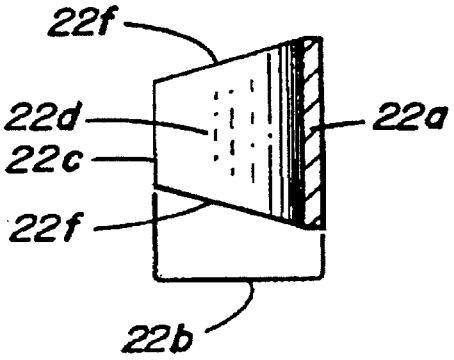
FIG. 1C is a top view of the fish hook portion of the hold-down as viewed from BB in FIG. 1B.

Now referring to FIGS. 1B and 1C, the fish hook portion 22 comprises a flat proximal part **22*a*, a curved distal part 22*b* and a tip 22*c*. The distal part 22*b* further comprises a top surface 22*d*, a bottom surface 22*e* and lateral surfaces 22*f*. The top and bottom surfaces 22*d*, 22*e* of the distal part 22*b* are curved or angled with respect to an axis along the proximal part 22*a*. The lateral surfaces 22*f* of the distal part 22*b* are tapered towards the tip 22*c* as shown in FIG. 1C. The tip 22*c* of the fish hook portion 22** engages an inside wall of a hold-down engagement hole on a circuit assembly.

Figure 2:
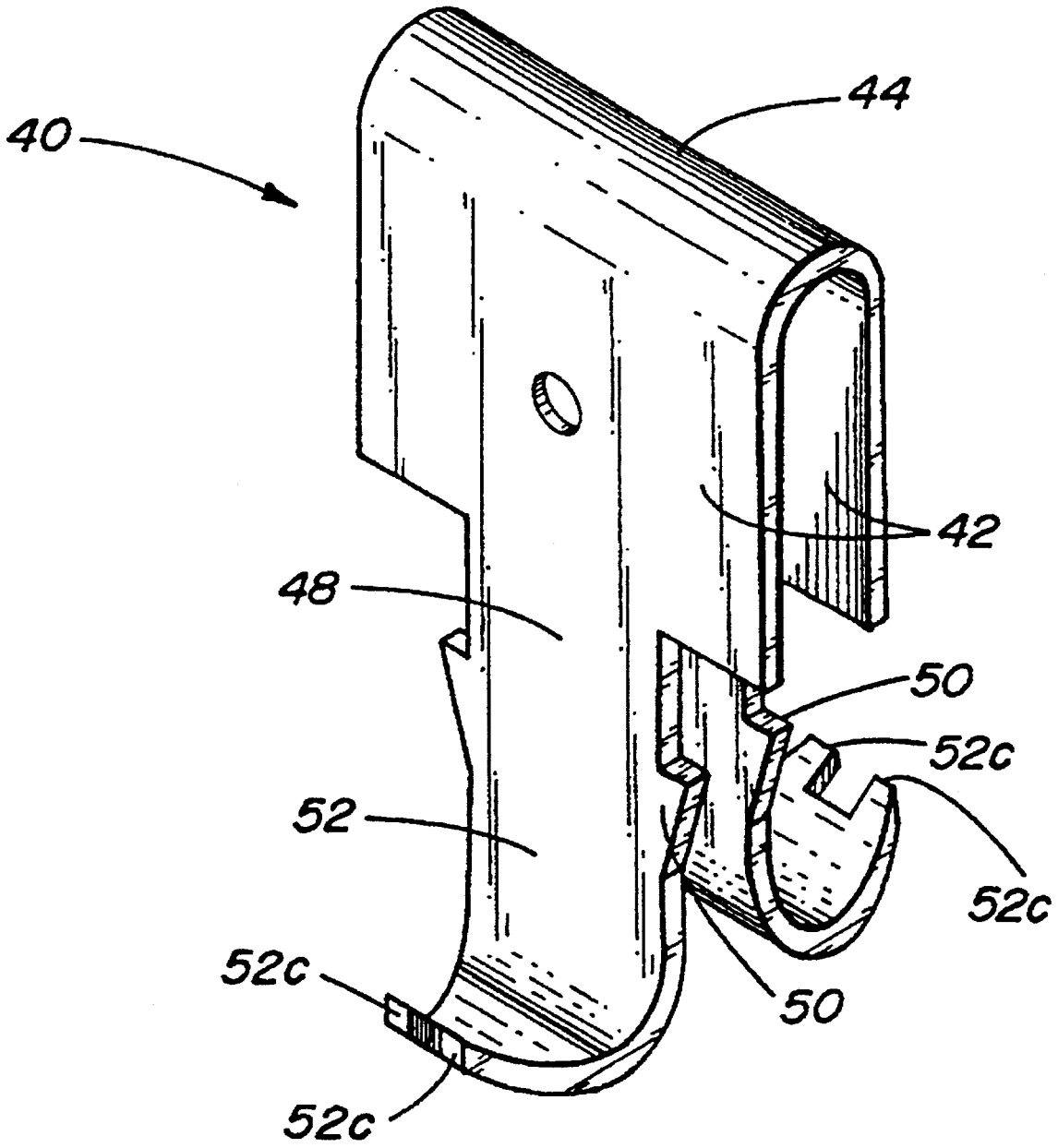
FIG. 2 illustrates another embodiment of the fish hook hold-down of the current invention.

FIG. 2 shows a second embodiment of the current invention. As described above for FIG. 1, a fish hook hold-down 40 comprises an adjoining portion 44, connector housing contact portions 42, intermediate portions 48, barbs 50, fish hook portions 52 and tips **52*c*. The difference between the embodiment as shown in FIG. 1 and this embodiment as shown in FIG. 2 is bifurcated fish hook portion 52, each of which provides two tips 52*c*. These tips 52*c*** provide a better grip of the inside wall for stronger anchoring.

Figure 3:
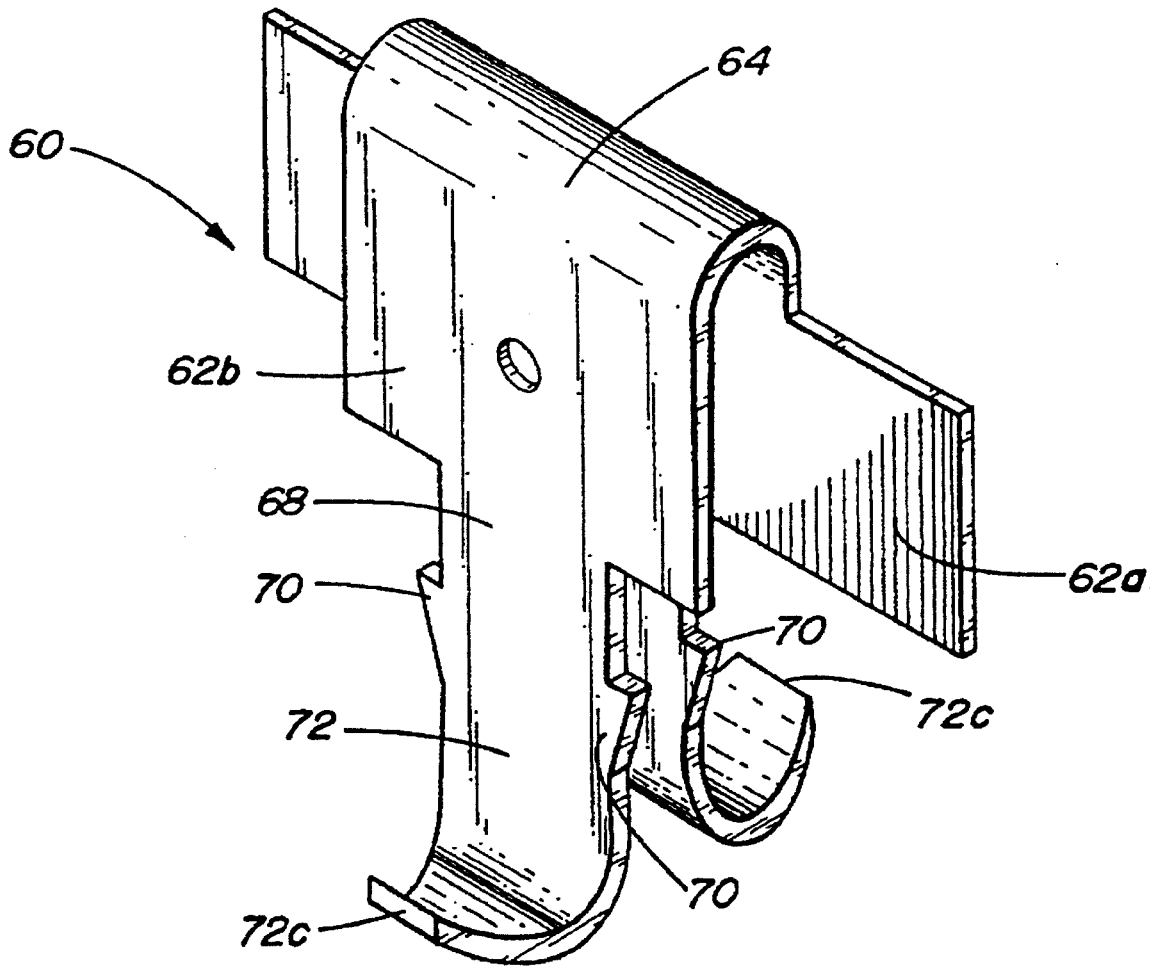
FIG. 3 illustrates yet another embodiment of the fish hook hold-down of the current invention.

FIG. 3 shows a third embodiment according to the current invention. As described above for FIG. 1, a fish hook hold-down 60 comprises ah adjoining portion 64, connector housing contact portions **62*a*, 62*b*, intermediate portions 68, barbs 70, fish hook portions 72 and tips 72*c*. The difference between the embodiment as shown in FIG. 1 and this embodiment as shown in FIG. 3 is the extended connector housing contact portion 62*a*, which provides an increased contact area with the connector housing for further stabilization of the hold-down 60**.

Figure 4A:
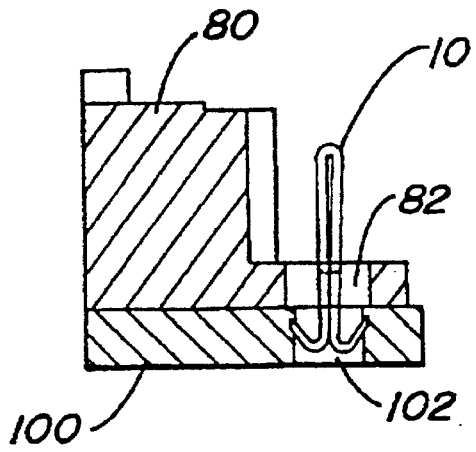
FIG. 4A and 4B are cross-sectional drawings of the fish hook hold-down placed in a connector housing and a circuit assembly.
Figure 4B:
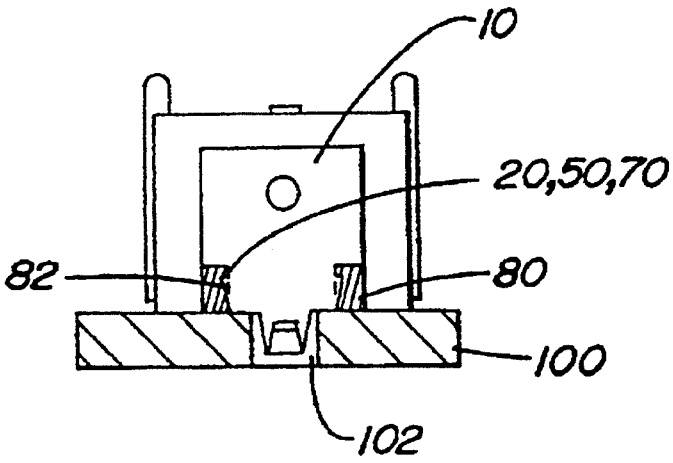
Figure 4C:
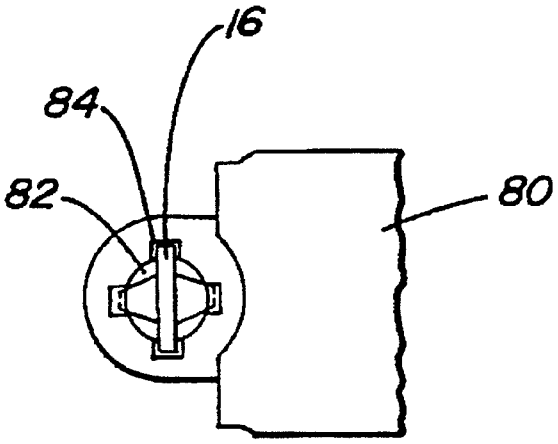
FIG. 4C is a top view of the connector housing and a hold-down of the current invention.
Figure 4D:
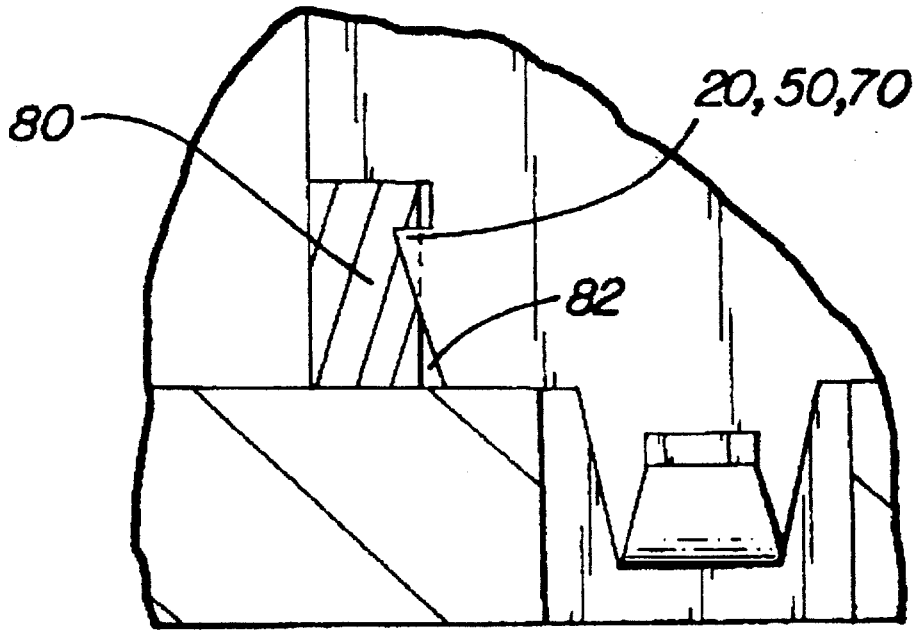
FIG. 4D is an enlarged partial cross-sectional view of FIG. 4B.

The hold-downs 10, 40 and 60 of FIGS. 1, 2 and 3 secure a connector housing 80 to a circuit assembly 100 as shown in FIGS. 4A, 4B and 4D. The hold-down 10 is disposed in a bore created by a hold-down retaining hole 82 and a hold-down engagement hole 102, which may be either unplatted or plated by a soft material such as aluminum. The hold-down 10 secures the connector housing by urging the end surface 16 of the connector housing contact portion 12 against a top surface of the connector housing 80 near the hold-down retaining hole 82. In a preferred embodiment, as shown in FIG. 4C, a vertical slit 84 on the top surface of the connector housing accepts the end surface 16. The tips 22*c* of the hold-down 10 anchor themselves to an inside wall of the hold-down engagement hole 102. In fact, the tips 22*c* may dig into the inside wall if the inside wall is sufficiently deformable and sufficient pressure is applied to the tips 22*c*. Such digging also takes place when the connector housing 80 is pulled away from the circuit assembly 100 and withstands up to 20 pounds of pressure to prevent the separation of the connector housing 80 from the circuit assembly 100. Thus, the connector housing 80 and the circuit assembly 100 are held together mainly by the connector housing contact portion 2.2 and the fish hook portions 22 of the hold-down 10.

Figure 5A:
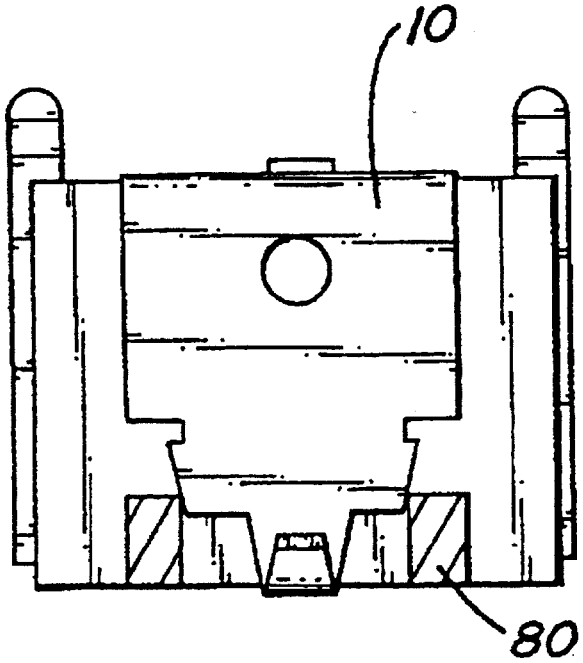
FIG. 5A is a cross-sectional drawing of the fish hook hold-down inserted into a connector housing.
Figure 5B:
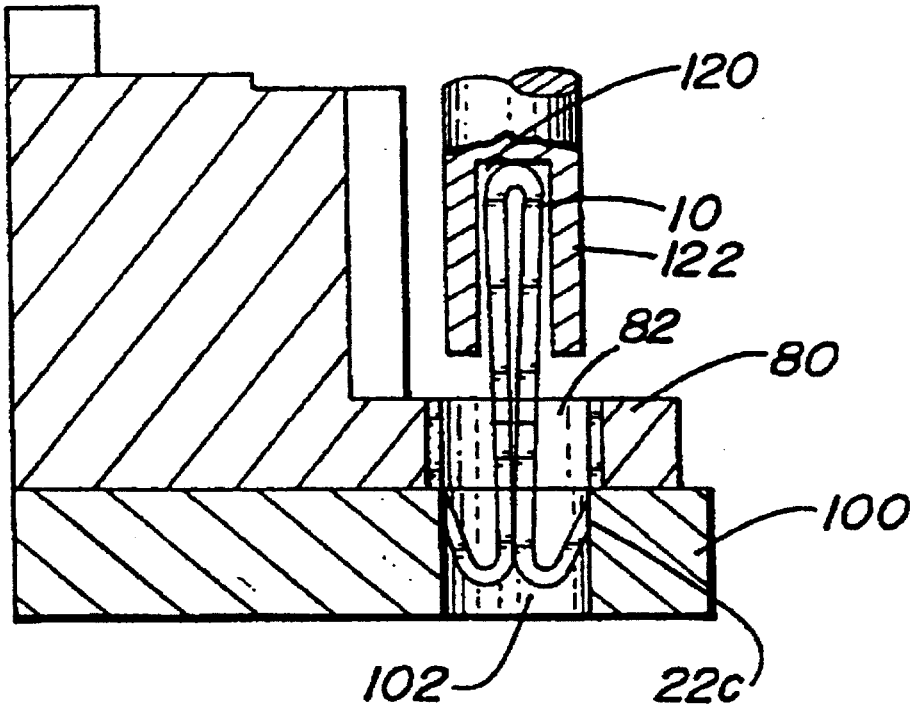
FIG. 5B is cross-sectional drawing of the fish hook hold-down inserted into a circuit assembly.
Figure 5C:
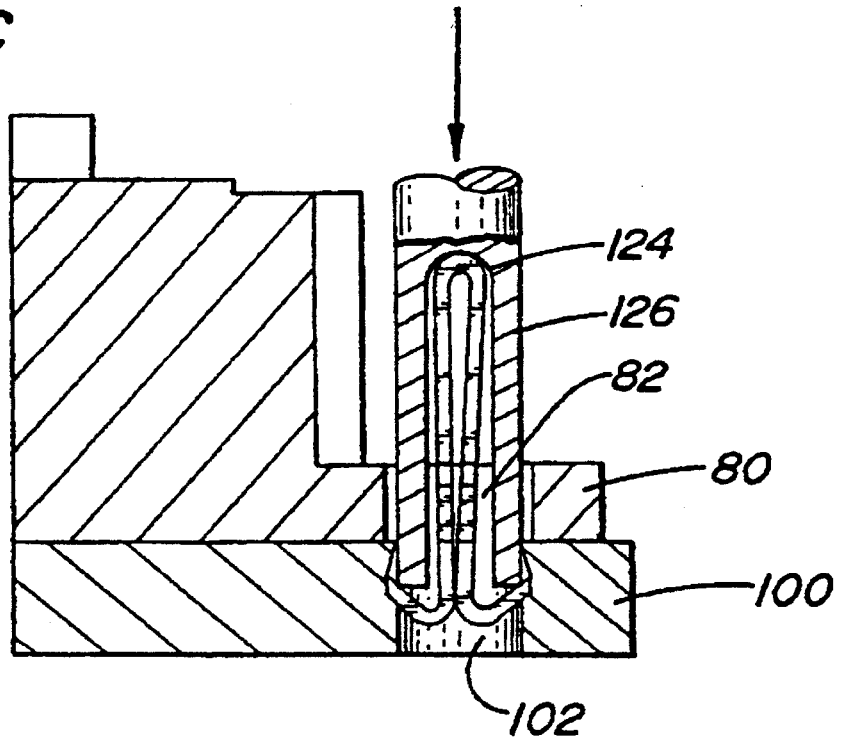
FIG. 5C is a cross-sectional drawing of the fish hook portions being spread a further apart in the hold-down engagement hole.

In order to properly secure a connector housing to a circuit assembly, a fish hook hold-down according to the current invention is placed in the connector housing and the circuit assembly in the following manner as shown in FIGS. 5A–5C. First, referring to FIG. 5A, the hold-down 10 is placed in a hold-down retaining hole 82 in the connector housing 80. The barbs 20 of the hold-down 10 have an interference fit with the hold-down retaining hole 82 or the vertical slot so as to temporarily fastens the hold-down 10 in the connector housing 80. Since the interference fit of the barbs 20 is sufficiently strong to prevent the hold-down 10 from disengaging the connector housing during transportation, the connector housing 80 may be shipped with the hold-down 10 in the hold-down retaining hole 82 for later assembling with a circuit board 100. The interference fit also eliminates a special compartment to accept the connector housing contact portion of the hold-down 10.

Now referring to FIG. 5B, the connector housing 80 with the hold-down 10 is placed over a hold-down engagement hole 102 of a circuit board 100. An application tool #1 has a small retaining pocket 120 with short legs 122 while an application tool #2 has a large retaining pocket 124 and long legs 126. The application tool #1 is first placed over the adjoining portion 14 so that the adjoining portion 14 is placed inside a retaining pocket of the application tool #1. The hold-down 10 is inserted into the hold-down engagement hole 102 while the tips 22*c* urge against an inside wall of the hold-down engagement hole 102. Then, as shown in FIG. 5C, the application tool #2 is placed over the hold-down 10 so that the tips of the legs 126 presses against the top surface 22*d* of the fish hook portion of the hold-down 10. A downward movement of the application tool #2 causes the fish hook portions to further spread apart and dig into the inner wall of the hold-down engagement hole 102. Although FIGS. 5B and 5C show a two-step assembling process of the connector housing 80 and the circuit assembly 100, the assembling process involves only one step as shown in FIG. 6.

Figure 6:
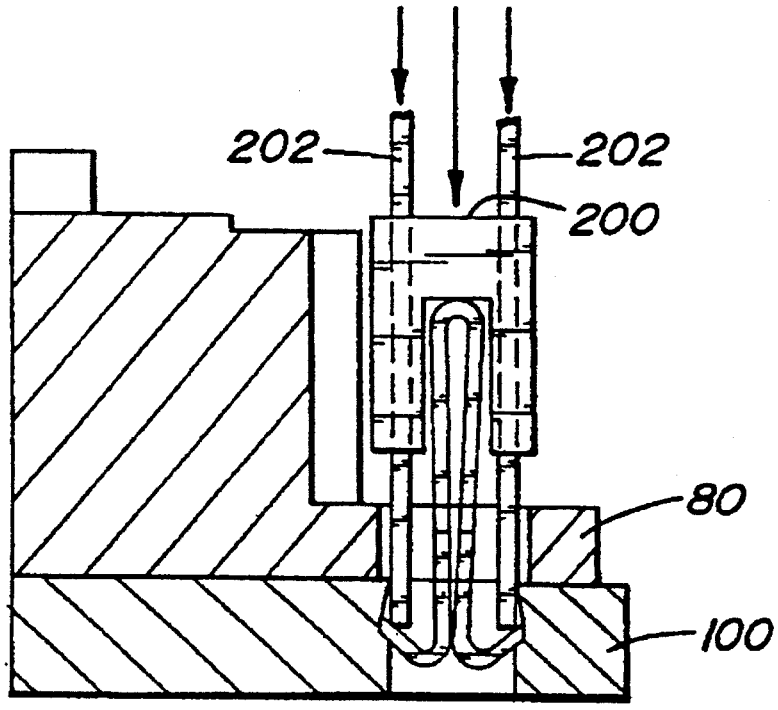
FIG. 6 illustrates a single assembling step of the connector housing and a circuit board.

FIG. 6 shows an application tool #3 for a single-step assembly of a connector housing 80 and a circuit assembly 100. The application tool #3 simultaneously causes the insertion of a fish hook portion 22 into a hold-down engagement hole 102 by applying pressure to a first surface 200 as well as the extension of the fish hook portion 22 by applying pressure to a second surface 202 as respectively indicated by arrows.

Figure 7:
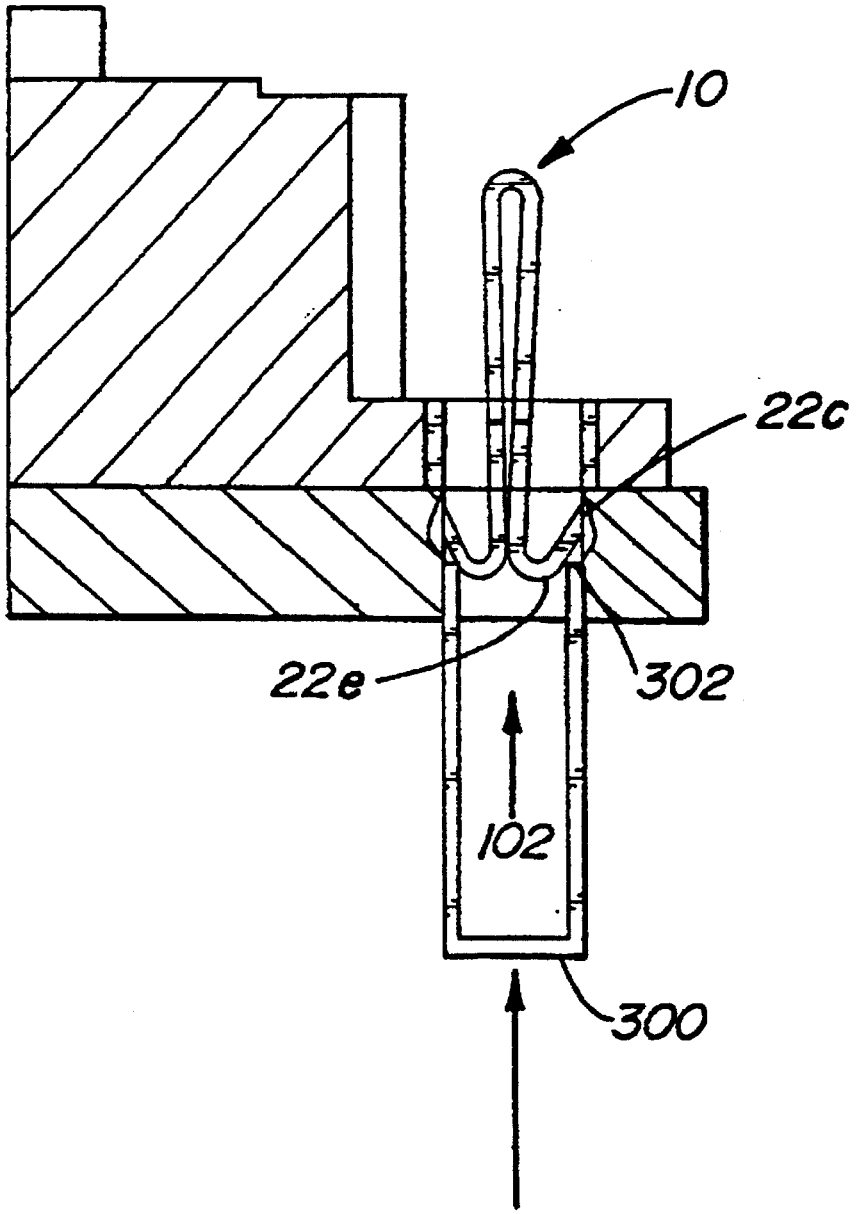
FIG. 7 illustrates a removal process of the fish hook hold-down from the circuit assembly.

FIG. 7 illustrates a removal process of the fish hook hold-down 10 from the circuit assembly 100. A removal tool 300 is inserted into a hold-down engagement hole 102 from the bottom of the circuit assembly 100. Tips 302 of the removal tool 300 engages the bottom surface 22*e* of the fish hook portion 22, and an upward motion as indicated by an arrow causes the fish hook tip portion 22*c* to disengage from an inside wall of the hold-down engagement hole 102.

A hold-down according the current invention provides a higher tolerance for the misalignment of the fish hook portions with respect to a hold-down engagement hole in a circuit assembly. Since at least two fish hooks are placed back-to-back and urge against opposite sides of the inner walls, the misalignment of the hold-down with respect to the hold-down engagement hole is substantially corrected during the insertion process. In addition, the inserted fish hook portions are further adjusted and spread apart so that the misalignment is further eliminated.

Consequently, another advantage of the current hold-downs is an increased retention force due to the multiple fish hooks which are anchored into the inside wall.

Yet another advantage of the current invention includes a simplified design of the connector housing contact portion of the hold-down. Since a connector housing is pressed down by a straight edge of the connector housing contact portion or the straight edge is placed in a vertical slot on the connector housing, the connector housing does not have to be specifically configured for accepting the contact portion.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed. For example, although not shown, it is well within a scope of the current invention to have a second intermediate portion and/or a second fish hook portion which are stamped out from a first intermediate portion or a first hook portion.

What is claimed is:

1. A hold-down for securing a connector housing to a circuit assembly, the circuit assembly having a hold-down engagement hole defined by an inner wall, the hold-down comprising:

a top portion for contacting the connector housing and for securing the hold-down to the connector housing at a top surface of the connector housing; and shoulder portions integral with said top portion having downwardly facing end surfaces projecting in a horizontal direction substantially parallel to the top surface to engage the connector housing;

a plurality of fish hooks each integral with said top portion, each of said fish hooks having a proximal end adjacent to said top portion and a distal end opposite said proximal end, a portion near said distal end being angled with respect to an axis along a portion near said proximal end and said top portion and defining an angled tip, said angled tip adapted to resiliently engaged the inner wall of the hold-down engagement hole of the circuit assembly so as to have an interference fit, said projection of said top portion adapted to maintain said angled tip in engagement with the inner wall.

2. The hold-down according to claim 1, wherein said top portion further comprises:

a grip area for providing a grip to hold the hold-down;

a plurality of intermediate portions each having a first ends and a second end, said first end of said intermediate portions being integral with said proximal ends of said fish hooks; and an joining portion integral with said second end of said intermediate portion for adjoining said plurality of intermediate portions.

3. The hold-down according to claim 1, wherein said angled tips dig into the inner wall of the hold-down engagement hole as the connector housing is pulled away from the circuit assembly.

4. The hold-down according to claim 2, wherein each of said intermediate portions further comprises a protrusion for temporarily securing the hold-down to the connector housing.

5. The hold-down according to claim 4, wherein the connector housing has a hold-down retaining through hole, said protrusion being a barb located on the side of the intermediate portion to have an interference fit in the hold-down retaining through hole.

6. A hold-down for holding a connector housing to a circuit assembly, the circuit assembly having a hold-down engagement hole, and the connector housing having a hold-down retaining through hole the hold-down comprising:

a plurality of connector housing contact portions for securing the hold-down to the connector housing;

a plurality of intermediate portions each having a first end and a second end, said first end of each of said intermediate portions being integral with one end of said connector housing contact portion, each of said intermediate portions having a barb for an interference fit in the hold-down retaining through hole so as to temporarily secure the hold-down to the connector housing;

an adjoining portion located at the other end of said connector housing contact portion for adjoining said plurality of said connector housing contact portions; and a plurality of fish hooks each integral with said second end of said intermediate portion, each of said fish hooks having a proximal end adjacent to said second end of said intermediate proximal and a distal end opposite said proximal end, a portion near said distal end being angled with respect to an axis along a proximal near said proximal end and said intermediate portion and defining an angled tip, said angled tip adapted to be resiliently engaging an inner wall of the hold-down engagement hole of the circuit assembly so as to have an interference fit.

7. The hold-down according to claim 6, wherein said adjoining portion serves as a spring to urge said connector housing contact portions against the connector housing so as to increase a retention force of the hold-down for retaining the connector housing.

8. The hold-down according to claim 6, wherein each of said fish hooks further comprises lateral surfaces, a top inner surface and a bottom outer surface, said distal end portion of said top inner and said bottom outer surfaces being curved with respect to said proximal end portion of said top inner and said bottom outer surfaces defining a curved portion.

9. The hold-down according to claim 8, wherein said distal end portion of said lateral surfaces is tapered towards said angled tip.

10. The hold-down according to claim 9, wherein said curved portion serves as a spring to urge said angled tip against the inner wall of the hold-down engagement hole of the circuit assembly so as to increase a retention force of the hold-down for retaining the circuit assembly.

11. The hold-down according to claim 6, wherein said retention of the hold-down is approximately 20 pounds.

12. The hold-down according to claim 6, wherein the hold-down engagement hole is a drill through hole on a printed circuit board.

13. The hold-down according to claim 6, wherein the hold-down engagement hole is a plated through hole on a printed circuit board.

14. The hold-down according to claim 6, wherein said angled tip digs into the inner wall of the hold-down engagement hole as the connector housing is pulled away from the circuit assembly.

15. A fish-hook hold-down for holding a connector housing to a circuit assembly, the circuit assembly having a hold-down engagement hole, and the connector housing having a hold-down retaining through hole the fish-hook hold-down comprising:

a plurality of connector housing contact portions for securing the fish-hook hold-down to the connector housing;

a plurality of intermediate portions each having a first end and a second end, said first end of each of said intermediate portions being integral with one end of said connector housing contact portion, each of said intermediate portions having a barb for an interference fit in the hold-down retaining through hole so as to temporarily secure the hold-down to the connector housing;

a plurality of fish hooks each integral with said second end of said intermediate portion, each of said fish hooks having a proximal end adjacent to said second end of said intermediate portion and a distal end opposite said proximal end, a portion near said distal end being angled with respect to an axis along a portion near said proximal end and said intermediate portion and defining an angled tip, said angled tip resiliently engaging an inner wall of the hold-down engagement hole of the circuit assembly, a portion between said proximal end and said distal end defining a curved portion, said curved portion adapted to be serving as a spring to urge said angled tip against the inner wall of the hold-down engagement hole of the circuit assembly so as to increase retention force of the hold-down for retaining the circuit assembly; and an adjoining portion located at the other end of said connector housing contact portions for adjoining said plurality of said contact portions, said adjoining portion serving as a spring to urge said connector housing contact portions against the connector housing to increase a retention force of the hold-down for retaining the connector housing.

16. The hold-down according to claim 15, wherein each of said fish hooks further comprises lateral surfaces, a top inner surface and a bottom outer surface, said distal end portion of said top inner and said bottom outer surfaces being curved with respect to said proximal end portion of said top inner and said bottom outer surfaces defining a curved portion.

17. The hold-down according to claim 16, wherein said distal end portion of said lateral surfaces is tapered towards said angled tip.

* * * * *

UNITED STATES PATENT AND TRADEMARK OFFICE

CERTIFICATE OF CORRECTION

PATENT NO. : 5,591,048

DATED : Marlyn E. Hahn

INVENTOR(S) : January 7, 1997

It is certified that error appears in the above-indentified patent and that said Letters Patent is hereby corrected as shown below:

Column 7, Line 33 - The word "proxmial" should actually be the word "portion".

Signed and Sealed this

Twenty-first Day of April, 1998

Bruce Lehman

*Attest:*

BRUCE LEHMAN

*Attesting Officer*

*Commissioner of Patents and Trademarks*